US008022642B2

(12) United States Patent
Ashikaga et al.

(10) Patent No.: US 8,022,642 B2
(45) Date of Patent: Sep. 20, 2011

(54) DISCHARGE LAMP LIGHTING DEVICE

(75) Inventors: Toru Ashikaga, Saitama (JP); Kazushige Hirata, Saitama (JP)

(73) Assignee: Sanken Electric Co., Ltd., Saitama (JP)

( * ) Notice: Subject to any disclaimer, the term of this patent is extended or adjusted under 35 U.S.C. 154(b) by 0 days.

(21) Appl. No.: 12/514,723

(22) PCT Filed: Aug. 8, 2008

(86) PCT No.: PCT/JP2008/064287

§ 371 (c)(1),
(2), (4) Date: May 13, 2009

(87) PCT Pub. No.: WO2009/034798

PCT Pub. Date: Mar. 19, 2009

(65) Prior Publication Data

US 2010/0164385 A1 Jul. 1, 2010

(30) Foreign Application Priority Data

Sep. 14, 2007 (JP) ..... 2007-239918

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl. ..... 315/308; 315/291; 315/279; 315/307

(58) Field of Classification Search ..... None
See application file for complete search history.

(56) References Cited

U.S. PATENT DOCUMENTS

| | | | | |
|---|---|---|---|---|
| 6,954,364 | B2 * | 10/2005 | Min | 363/56.08 |
| 2005/0264239 | A1 | 12/2005 | Endo | |
| 2006/0038592 | A1 * | 2/2006 | Inoue et al. | 327/108 |
| 2008/0211423 | A1 | 9/2008 | Shinmen et al. | |

FOREIGN PATENT DOCUMENTS

| | | | |
|---|---|---|---|
| JP | 4229597 | A | 8/1992 |
| JP | 6267674 | A | 9/1994 |
| JP | 2002110388 | A | 4/2002 |
| JP | 2005340023 | A | 12/2005 |
| JP | 2006179420 | A | 7/2006 |

* cited by examiner

*Primary Examiner* — Anh Q Tran
(74) *Attorney, Agent, or Firm* — Bachman & LaPointe, P.C.

(57) ABSTRACT

A discharge lamp lighting device is provided to comprise tube current detecting circuits $\mathbf{5}_1$ to $\mathbf{5}_n$ for outputting detection signals $V_{I1}$ to $V_{In}$ of tube currents $I_1$ to $I_n$ flowing through each discharge lamp $\mathbf{1}_1$ to $\mathbf{1}_n$ from an inverter 3 connected to DC power source 2 via a plurality of transformers $\mathbf{4}_1$ to $\mathbf{4}_n$, a maximum detector 6 for detecting a maximum value $V_{IMX}$ of detected signals $V_{I1}$ to $V_{In}$ from current detector $\mathbf{5}_1$ to $\mathbf{5}_n$, a minimum detector 7 for detecting a minimum value $V_{IMN}$ of detected signals $V_{I1}$ to $V_{In}$ from current detector $\mathbf{5}_1$ to $\mathbf{5}_n$, a comparison circuit 8 for computing one or plural values of sum, difference, product and quotient between maximum value $V_{IMX}$ from maximum detector 6 and minimum value $V_{IMN}$ from minimum detector 7 to generate a cease signal $V_{CP}$ when the computed value exceeds a given value, and a control circuit 9 for halting operation of inverter 3 when comparison circuit 8 generates cease signal $V_{CP}$. The device can reliably detect arc discharge resulted from electric connection failure in discharge lamp or lamps by the computed values from comparison circuit 8 to positively protect discharge lamps from overheating by arc discharge at a bad connection location.

4 Claims, 8 Drawing Sheets

DISCHARGE LAMP LIGHTING DEVICE

TECHNICAL FIELD

This invention relates to a discharge lamp lighting device, in particular, of the type for protecting involved discharge lamps from overheating by arc discharge that may occur at a location of bad or poor connection in the discharge lamp under a high voltage application.

BACKGROUND OF INVENTION

Recent years have seen a popular utilization of thinned and power-saving liquid crystal display (LCD) panels as monitors for televisions and personal computers in lieu of prior art cathode ray tubes. Display of LCD panels is indicated by an illuminating device such as a backlight disposed behind LCD panels because they cannot emit a light themselves. A typical backlight for LCD panel usually includes a cold cathode fluorescent lamp (CCFL) of electric property to need application of high AC voltage thereto in the order of one thousand and several hundreds volt at the beginning of lighting and several hundreds volt after lighting. Most recently, expansion in size of LCD panels tends to promote smaller and longer CCFL tubes, requiring further increase in applied voltage and consumption power.

Here, when a discharge lump lighting device applies high AC voltage to CCFL with high frequency, undesirable arc discharge may possibly occur in a small space that may be formed due to looseness in connector or the like, disconnection of wiring pattern or crack in solder. For example, CCFL is more frequently connected to a secondary winding in a transformer for electric driving of CCFL, and the winding is formed of a narrow wire to well increase the number of turns. In this arrangement, arc discharge may be generated by disconnection in the secondary winding when it is subject to mechanical tension or nipping solder for soldering to terminals. In another aspect, without soldering terminals in transformer on a printed circuit board in a normal condition, it fails to form a firm electrical contact between terminals of transformer and wiring pattern on printed circuit board, and this may result in arc discharge at wrong contact portions. Otherwise, if any damage is incurred to wiring pattern or if any mechanical load is applied on wiring pattern due to thermal deformation of circuit board, wiring pattern is cut off while arc discharge may possibly develop at the disconnection portion. In addition, when either terminal or both terminals of CCFL are not appropriately inserted into a connector with contact failure, arc discharge may also happen at an area of imperfect electrical contact.

FIG. 10 illustrates a lighting system 100 by way of example of a prior art discharge lamp lighting device which comprises a power supply circuit (a power supply) 120 for boosting input voltage $V_{in}$ applied on an input terminal $T_{in}$ to apply a raised voltage on one end of a cold cathode fluorescent lighting tube (CCFL) 110, a protective circuit 140 inclusive of a current control circuit or current controller 210, an extinction detection circuit or extinction detector 220 and a forced outage circuit 230, and a current detection circuit or current detector 130 for converting electric current through CCFL 110 into a corresponding voltage to protective circuit 140. Current controller 210 serves to control the voltage impressed from power supply 120 to CCFL 110 to render an effective value in electric current flowing into CCFL 110 constant or consistent in response to detected voltage from current detector 130. Extinction detector 220 serves to detect extinction or disappearance of electric current through CCFL 110 in response to detected voltage from current detector 130 to generate an extinction detection signal to forced outage circuit 230. In other words, extinction detector 220 can appreciate lights out of CCFL 110 by sensing extinction of electric current through CCFL 110. When extinction detector 220 produces an extinction detection signal, forced outage circuit 230 functions to forcibly and temporarily stop operation of power supply 120. Lighting system 100 shown in FIG. 10 has a notable advantage that forced outage circuit 230 can forcibly and temporarily suspend operation of power supply 120 by forwarding an extinction detection signal from extinction detector 220 to forced outage circuit 230 in protective circuit 140 upon disappearance of electric current through CCFL 110 due to lighting failure of CCFL 110, disconnection of CCFL 110 from related connector or the like to thereby avert occurrence of arc discharge at a location of bad connection in CCFL 110.

Also, FIG. 11 demonstrates another lighting system 200 as a further prior art discharge lamp lighting device which comprises a CCFL 110 and a drive device 111 for activating CCFL 110. Drive device 111 comprises a power supply circuit or power supply 141, a current detection circuit or current detector 142, a peak hold circuit 143 and a protective circuit 144. Protective circuit 144 comprises a current control circuit 161, an extinction detection circuit or extinction detector 162, overcurrent detection circuit or overcurrent detector 163 and a forced outage circuit 164.

FIG. 12 indicates voltages appearing at several locations in lighting system 200 during its operation. For example, when arc discharges repeatedly emerge $n^-$ times during a period from point $t_1$ to $t_n$ in time as shown in FIG. 12(A) because of contact failure between CCFL 110 and related connector not shown in the drawings, spike-like surge voltages are superimposed on detected voltage from current detector 142 each time arc discharge occurs. These surge voltages of n-times cause to gradually electrically charge a voltage-hold capacitor (not shown) in peak hold circuit 143 to moderately increase charged voltage in voltage-hold capacitor as is understood by FIG. 12(B). When charged voltage in voltage-hold capacitor comes to a voltage level $V_{ref2}$ regulated by a reference power source (not shown) in overcurrent detector 163 at point $t_n$ in FIG. 12(B), overcurrent detector 163 produces an output signal of high voltage level as shown in FIG. 12(C) to forced outage circuit 164 which then forwards a stop signal of high voltage level to power supply 141. Accordingly, power supply 141 ceases its operation as shown in FIG. 4(D) to halt supply of high AC voltage from power supply 141 to CCFL 110. For that reason, current flow into CCFL 110 is ceased, and therefore, current detector 142 finds zero potential in detected voltage as shown in FIG. 12(A). At this time, voltage-hold capacitor in peak hold circuit 143 maintains charged voltage value $V_{ref2}$ at point $t_n$ until a reset signal of high voltage level shown in FIG. 12(E) is supplied to a reset terminal $T_r$ of peak hold circuit 143 to retain the outage condition for disconnecting supply of voltage from power supply 141 to CCFL 110 although a temporal contact is completed between CCFL 110 and connector. Then, when a reset signal of high voltage level as in FIG. 12(E) is supplied to reset terminal $T_r$ of peak hold circuit 143 at point $t_{11}$, voltage-hold capacitor in peak hold circuit 143 is electrically discharged to an approximately zero voltage as shown in FIG. 12(B) to switch output of overcurrent detector 163 from high to low voltage level as seen in FIG. 12(C). This allows power supply 141 to again feed high AC voltage to CCFL 110 so that current detector 142 again produces a detection voltage as in sinusoidal wave shown in FIG. 12(A).

When several arc discharges occur due to contact failure of CCFL 110 in lighting system 200 shown in FIG. 11, they cause concomitant surge voltages each time arc discharge is generated while each surge voltage is superimposed on detected voltage from current detector 142 and also impressed on voltage-hold capacitor within peak-hold circuit 143. In this condition, when voltage-hold capacitor is electrically charged to a predetermined potential level, overcurrent detector 163 in protective circuit 144 issues a stop signal of high voltage level to power supply 141 through forced outage circuit 164 to cease feed of high AC voltage from power supply 141 to CCFL 110 for protection of CCFL 110 from overheating by arc discharges attributable to a contact-failure location. For example, the following Patent Document 1 discloses a discharge lamp lighting device having the substantially same configuration as lighting systems 100 and 200 shown in FIGS. 10 and 11.

[Patent Document 1] Japanese Patent Disclosure No. 2005-340023

DISCLOSURE OF INVENTION

Problem to be Solved by Invention

By the way, in addition to the foregoing malfunction of CCFL, arc discharge may cause the following different disadvantageous phenomena as the culprit. For example, in case of arc discharge repeating its appearance and disappearance, it generates abnormal sparking noises while CCFL 110 repeats its lighting and extinction. In this case, current detector 130 shown in FIG. 10 can detect arc discharge relatively easily. On the other hand, with a longer disconnection distance, it produces a large voltage drop and considerably lowers voltage applied on CCFL 110 to significantly reduce electric current through CCFL 110. Even in this case, current detector 130 shown in FIG. 10 can detect arc discharge relatively easily. However, with a shorter disconnection distance, it produces little voltage drop at the disconnection location in CCFL 110 to thereby make it difficult to exactly detect arc discharge by current detector 13 of FIG. 10. In addition, relatively large amount of electric current running through CCFL 110, produces increased amount of heat at an arc discharge location so that a plastic housing in connector and a plastic printed circuit board will get carbonized by their overheating and be metamorphosed into electrical conductors, and if arc discharges successively come about, it may lead to a smoking or firing accident. In addition, composite phenomena of the foregoing events may be supposed to happen.

In short, lighting system 100 shown in FIG. 10 basically allows current detector 130 to monitor current flow through CCFL 110, and when current detector 130 picks up extinction of current flow through CCFL 110 from disconnection of printed circuit pattern and/or contact failure of CCFL 110, protective circuit 140 can stop operation of power supply 120. However, there may be a case where arc discharge occurs because of bad contact between a terminal of CCFL 110 and related connector under the high voltage application, and then the bad contact is accidentally returned to a temporal electrical continuity by a second contact between terminal of CCFL 110 and connector for some reason. Even in such a case, if high voltage is applied from power supply 120 to CCFL 110, arc discharge may again occur at the bad contact location. Thus, unfavorably prior art lighting system 100 cannot reliably detect arc discharge caused by contact failure of CCFL 110 and it indicates insufficient stability and reliability in operation.

Now, lighting system 200 shown in FIG. 11 also allows production of arc discharges for defective electric contact of CCFL 110, and at the moment, several surge currents pass in turn through CCFL 110 to electrically charge voltage-hold capacitor in peak hold circuit 143 by surge currents. When voltage-hold capacitor is charged to a predetermined level of reference voltage, forced outage circuit 164 causes power supply 141 to stop feed of high voltage to CCFL 110. However, lighting system 200 is still imperfect because peak hold circuit 143 can hardly detect arc discharges derived from incomplete connection in CCFL 110 when electric current through CCFL 110 slightly fluctuates in case of rare or no occurrence of surge currents.

Accordingly, an object of the present invention is to provide a discharge lamp lighting device capable of certainly detecting arc discharge resulted from connection failure in a discharge lamp to reliably protect the discharge lamp from overheating by arc discharge at a connection failure location.

Means for Solving the Problem

The discharge lamp lighting device according to the present invention comprises an inverter circuit (3) for converting DC voltage from a DC power source (2) into AC voltage, transformers ($\mathbf{4}_1$ to $\mathbf{4}_n$) which include a plurality of primary windings ($\mathbf{4}a_1$ to $\mathbf{4}a_n$) and a plurality of secondary windings ($\mathbf{4}b_1$ to $\mathbf{4}b_n$), each primary winding ($\mathbf{4}a_1$ to $\mathbf{4}a_n$) being in parallel connection to output terminals of inverter circuit (3), and discharge lamps ($\mathbf{1}_1$ to $\mathbf{1}_n$) each connected to respective secondary windings ($\mathbf{4}b_1$ to $\mathbf{4}b_n$). The lighting device further comprises tube current detecting circuits or current detectors ($\mathbf{5}_1$ to $\mathbf{5}_n$) connected between secondary winding ($\mathbf{4}b_1$ to $\mathbf{4}b_n$) of each transformer ($\mathbf{4}_1$ to $\mathbf{4}_n$) and each discharge lamp ($\mathbf{1}_1$ to $\mathbf{1}_n$) for detecting tube current ($I_1$ to $I_n$) through discharge lamp ($\mathbf{1}_1$ to $\mathbf{1}_n$) to produce detection signals ($V_{I1}$ to $V_{In}$) of the level corresponding to detected tube current ($I_1$ to $I_n$), a maximum detection circuit or maximum detector (6) for detecting a maximum value ($V_{IMX}$) of detected signals ($V_{I1}$ to $V_{In}$) from current detector ($\mathbf{5}_1$ to $\mathbf{5}_n$), a minimum detection circuit or minimum detector (7) for detecting a minimum value ($V_{IMN}$) of detected signals ($V_{I1}$ to $V_{In}$) from current detector ($\mathbf{5}_1$ to $\mathbf{5}_n$), a comparison circuit (8) for computing one or plural values of sum, difference, product and quotient by addition, subtraction, multiplication and division between maximum value ($V_{IMX}$) from maximum detector (6) and minimum value ($V_{IMN}$) from minimum detector (7) to generate a cease signal ($V_{CP}$) when the computed value exceeds a predetermined value, and a control circuit (9) for halting operation of inverter circuit (3) when comparison circuit (8) generates cease signal ($V_{CP}$).

During lighting operation of the lighting device, arc discharge happens due to incomplete electrical connection in one or more of discharge lamps ($\mathbf{1}_1$ to $\mathbf{1}_n$) with concomitant reduction in tube current ($I_1$) passing through imperfect connection, and this gives rise to adverse increase in an amount of tube current ($I_1$) passing through the remaining good discharge lamp or lamps, thereby resulting in increase in difference between maximum and minimum values ($I_{MAX}$ and $I_{MIN}$) of tube current ($I_1$ to $I_n$) flowing through plural discharge lamps ($I_1$ to $I_n$). In this case, even though bad discharge lamp or lamps produce little reduction in their tube current ($I_1$), good discharge lamp or lamps absolutely augment their tube current ($I_1$), enlarging the difference between maximum and minimum values ($I_{MAX}$ and $I_{MIN}$) of tube current ($I_1$ to $I_n$). In this view, the instant invention contemplates that firstly, current detectors ($\mathbf{5}_1$ to $\mathbf{5}_n$) pick up tube current ($I_1$ to $I_n$) of plural discharge lamps ($\mathbf{1}_1$ to $\mathbf{1}_n$) to generate detection signals ($V_{I1}$ to $V_{In}$) accordant with tube current ($I_1$ to $I_n$); secondly, maximum and minimum detectors (6, 7) catch with high accuracy respectively maximum and minimum values ($I_{MAX}$ and $I_{MIN}$) in detection signals ($V_{I1}$ to $V_{In}$); thirdly, comparison circuit (8) calculates one or plural values of sum, difference, product or quotient of maximum and minimum values ($I_{MAX}$ and $I_{MIN}$); and finally, comparison circuit (8) produces a stop signal ($V_{cp}$), for example, when difference ($V_{DP}$) between maximum and minimum values ($I_{MAX}$ and $I_{MIN}$) reaches a potential level that exceeds a predetermined level of reference voltage ($V_{R1}$) to cease operation of inverter circuit (3) through control circuit (9). Thus, the lighting device can surely appreciate occurrence of arc discharge arisen from incomplete connection in discharge lamp or lamps by means of computed value or values in comparison circuit (8) and cease feed of power from inverter circuit (3) to discharge lamps to positively protect discharge lamps from overheating by arc discharge at a location of connection failure.

Effect of Invention

The present invention resorts to the technical concept that includes means for exactly at first picking up with high accuracy maximum and minimum values in tube currents flowing through plural discharge lamps, and means for calculating one or plural computed values of sum, difference, product and quotient of maximum and minimum values so that the computed values serve to effectively determine occurrence of arc discharge at a connection failure location in discharge lamp or lamps and to safeguard discharge lamps from overheating by arc discharge at the location.

EXPLANATION OF LETTERED SUFFIXES $\mathbf{1}_1$ to $\mathbf{1}_n$ . . . First to $n^{th}$ CCFLs (Discharge lamps), 2 . . . A DC power source, 3 . . . An inverter circuit, $\mathbf{4}_1$ to $\mathbf{4}_n$ . . . First to $n^{th}$ transformers, $\mathbf{4}a_1$ to $\mathbf{4}a_n$ . . . Primary windings, $\mathbf{4}b_1$ to $\mathbf{4}b_n$ . . . Secondary windings, $\mathbf{5}_1$ to $\mathbf{5}_n$ . . . First to $n^{th}$ tube current detecting circuit, 6 . . . A maximum detection circuit, 7 . . . A minimum detection circuit, 8 . . . A comparison circuit, 9 . . . A control circuit, 10 . . . An operational amplification circuit, 11 . . . A comparator, 12 . . . A power source of reference voltage, 13 . . . A retention circuit, $\mathbf{14}_1$, $\mathbf{15}_1$ to $\mathbf{14}_n$, $\mathbf{15}_n$ . . . First to $n^{th}$ output connectors, 16 . . . A disconnection-detecting AND gate (A disconnection detecting circuit).

BEST MODE FOR CARRYING OUT THE INVENTION

Embodiments are described hereinafter with reference to FIGS. 1 to 9 regarding the discharge lamp lighting device according to the present invention actually applied to lighting devices for cold cathode fluorescent discharge lamps or tubes (CCFL).

Figure 1:
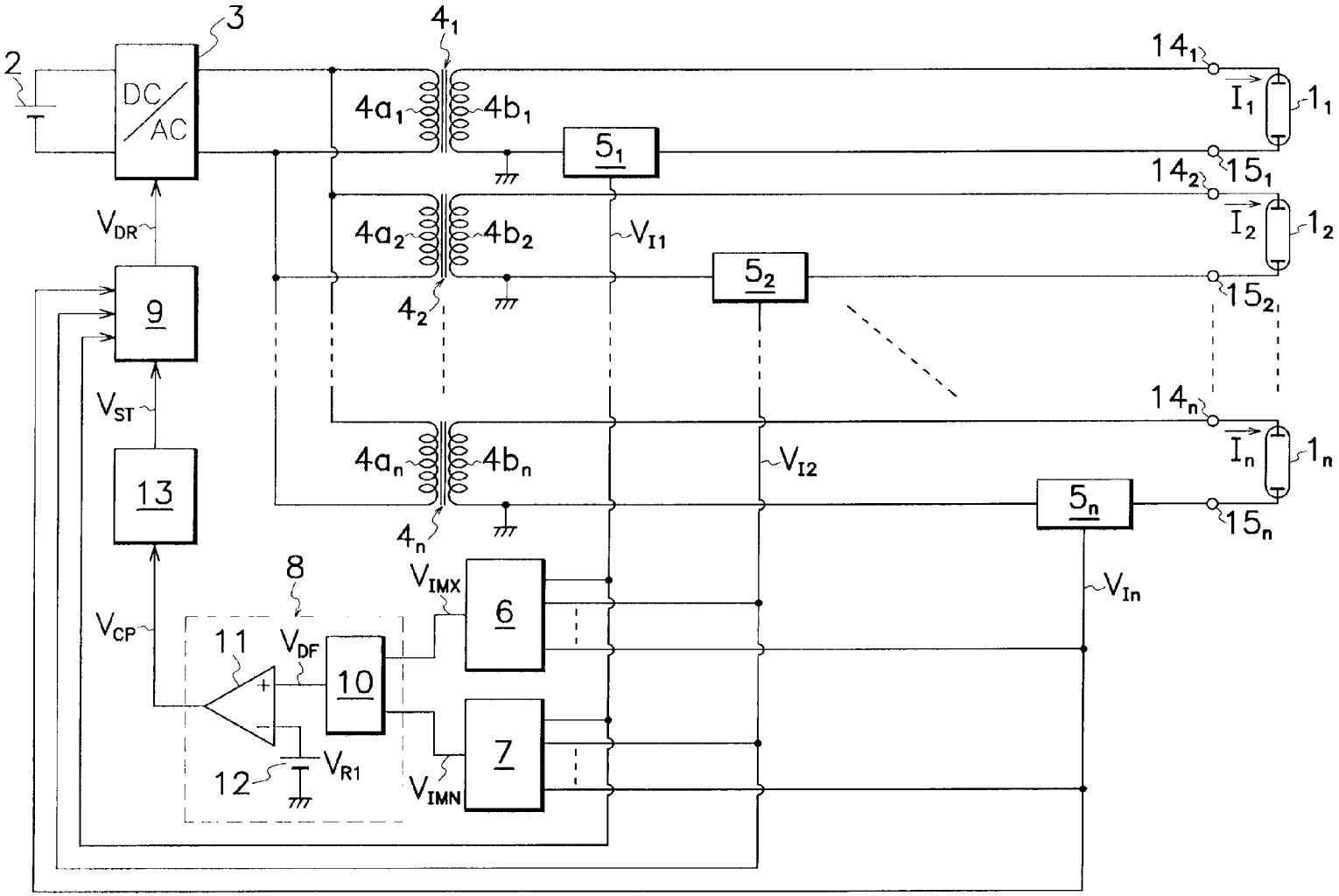
FIG. 1 An electric circuit diagram showing a first embodiment of the discharge lamp lighting device according to the present invention.

As shown in FIG. 1, the discharge lamp lighting device according to a first embodiment of the present invention, comprises an inverter circuit or inverter 3 for converting DC voltage from a DC power source 2 into AC voltage, first to $n^{th}$ transformers $\mathbf{4}_1$ to $\mathbf{4}_n$ which include first to $n^{th}$ primary windings $\mathbf{4}a_1$ to $\mathbf{4}a_n$ and first to $n^{th}$ secondary windings $\mathbf{4}b_1$ to $\mathbf{4}b_n$, each primary winding $\mathbf{4}a_1$ to $\mathbf{4}a_n$ being in parallel connection to output terminals of inverter 3, and first to $n^{th}$ cold cathode fluorescent discharge tubes or discharge lamps $\mathbf{1}_1$ to $\mathbf{1}_n$ each connected to respectively first to $n^{th}$ secondary windings $\mathbf{4}b_1$ to $\mathbf{4}b_n$ through first to $n^{th}$ output connectors $\mathbf{14}_1$, $\mathbf{15}_1$ to $\mathbf{14}_n$, $\mathbf{15}_n$. The lighting device shown in FIG. 1 also comprises first to $n^{th}$ tube current detecting circuit or current detector $\mathbf{5}_1$ to $\mathbf{5}_n$ connected between each secondary winding $\mathbf{4}b_1$ to $\mathbf{4}b_n$ of first to $n^{th}$ transformers $\mathbf{4}_1$ to $\mathbf{4}_n$ and each of first to $n^{th}$ discharge lamps $\mathbf{1}_1$ to $\mathbf{1}_n$ for detecting tube currents $I_1$ to $I_n$ through discharge lamps $\mathbf{1}_1$ to $\mathbf{1}_n$ to produce detection voltages $V_{I1}$ to $V_{In}$ of the level corresponding to detected tube current $I_1$ to $I_n$, a maximum detection circuit or maximum detector 6 for detecting and outputting a maximum value $V_{IMX}$ corresponding to a maximum current value $I_{MAX}$ of tube currents $I_1$ to $I_n$ detected by first to $n^{th}$ current detectors $\mathbf{5}_1$ to $\mathbf{5}_n$, a minimum detection circuit or minimum detector 7 for detecting and outputting a minimum value $V_{IMN}$ corresponding to a minimum current value $I_{MIN}$ of tube currents $I_1$ to $I_n$ detected by first to $n^{th}$ current detectors $\mathbf{5}_1$ to $\mathbf{5}_n$, a comparison circuit 8 for computing a difference in voltage between maximum voltage value $V_{IMX}$ from maximum detector 6 and minimum voltage value $V_{IMN}$ from minimum detector 7 to generate a cease signal $V_{CP}$ when the potential difference value exceeds a predetermined value, and a control circuit 9 for controlling AC output voltage from inverter 3 depending on each detected voltage $V_{I1}$ to $V_{In}$ from first to $n^{th}$ current detectors $\mathbf{5}_1$ to $\mathbf{5}_n$, and for producing a drive signal $V_{DR}$ for halting operation of inverter 3 when comparison circuit 8 generates cease signal $V_{CP}$. Not shown in the drawings, but, inverter 3 may comprises a plurality of switching elements for example like MOS-FETs, IGBTs (Insulated Gate Bipolar Transistors) or GTOs (Gate Turn Off Thyristors) connected in bridge to DC power source 2 to control on-off operation of plural switching elements in accordance with drive signals $V_{DR}$ from control circuit 9 and thereby convert DC voltage from DC power source 2 into AC voltage in the order of hundreds to one thousand and several hundreds volt with the frequency of several tens kilohertz.

Comparison circuit 8 comprises an operational amplification circuit or operational amplifier 10 for outputting a differential or subtracted signal $V_{DF}$ between maximum voltage value $V_{IMX}$ from maximum detector 6 and minimum voltage value $V_{IMN}$ from minimum detector 7, and a comparator 11 for producing a cease signal $V_{CP}$ of high voltage level when differential signal $V_{DF}$ from operational amplifier 10 comes to a voltage level that exceeds a reference voltage $V_{R1}$ of a normative power supply 12. Connected between comparison circuit 8 and control circuit 9 is a retention circuit 13 for maintaining cease signal $V_{CP}$ from comparison circuit 8 in its original voltage level to deliver an abeyance retention signal $V_{ST}$ to control circuit 9 until a reset signal $V_{RT}$ is applied to a reset terminal 136 of retention circuit 13. In this way, control circuit 9 continues to stop operation of inverter 3 during the period of time while retention circuit 13 outputs abeyance retention signal $V_{ST}$.

Figure 3:
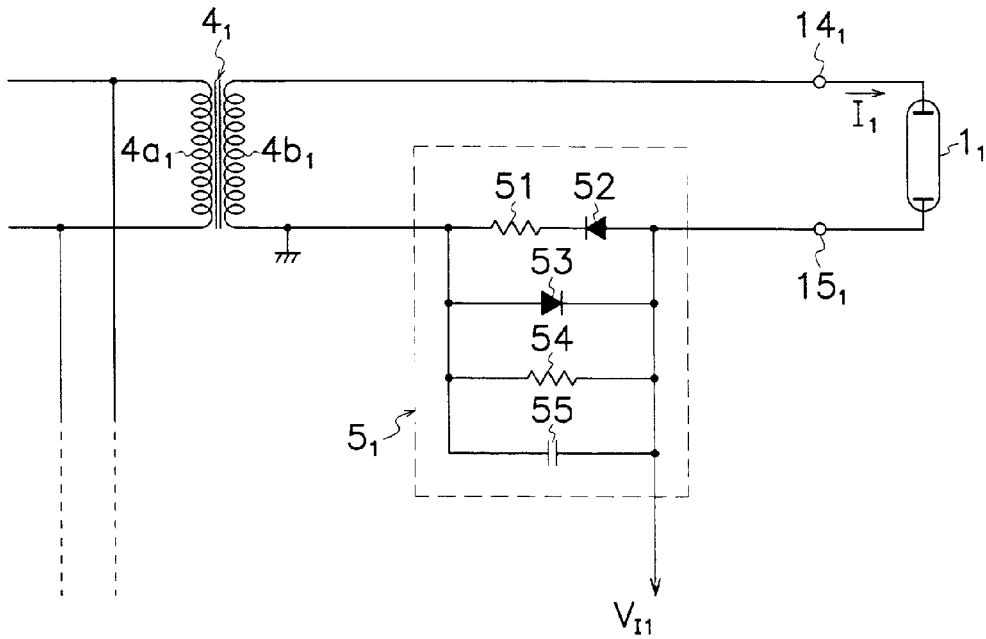
FIG. 3 An electric circuit diagram showing a detail of a tube current detecting circuit.

As is apparent from FIG. 3, a first cold cathode fluorescent discharge tube $\mathbf{1}_1$ is connected between one and the other first output connectors $\mathbf{14}_1$ and $\mathbf{15}_1$. A first tube current detecting circuit or current detector $\mathbf{5}_1$ comprises a detective resistor 51 and a rectification diode 52 connected in series to each other between the other first output connector $\mathbf{15}_1$ and an earthed end of a second winding $\mathbf{4}b_1$ in a first transformer $\mathbf{4}_1$, a diode 53 connected in parallel to a series circuit of current detector 51 and rectification diode 52 for reverse conduction of diode 53, a resistor 54 connected in parallel to diode 53, and a smoothing capacitor 55 connected in parallel to resistor 54. In operation of first discharge tube $\mathbf{1}_1$ shown in FIG. 3, when tube current $I_1$ flows from secondary winding $\mathbf{4}b_1$ of first transformer $\mathbf{4}_1$ to first discharge tube $\mathbf{1}_1$ during the positive half cycle, rectification diode 52 in first current detector $\mathbf{5}_1$ is biased in the forward direction to produce at both ends of current detector $\mathbf{5}_1$ detection voltage $V_{I1}$ proportional to tube current $I_1$. Also, when tube current $I_1$ flows from secondary winding $\mathbf{4}b_1$ of first transformer $\mathbf{4}_1$ to first discharge tube $\mathbf{1}_1$ during the negative half cycle, rectification diode 52 is biased in the adverse direction to block current flow through detective resistor 51 which therefore refrains from producing detection voltage $V_{I1}$ while tube current $I_1$ is sent through reversely biased diode 53. Detection voltage $V_{I1}$ appearing at both ends of detective resistor 51 is smoothed through resistor 54 and smoothing capacitor 55 to convert detection voltage $V_{I1}$ into one whose voltage level varies in response to change in a positive maximum value of tube current $I_1$. Not shown in the drawings, but each of second to $n^{th}$ tube current detectors $\mathbf{5}_2$ to $\mathbf{5}_n$ has the same circuit configuration and performs the same operation as those of first current detector $\mathbf{5}_1$.

Figure 4:
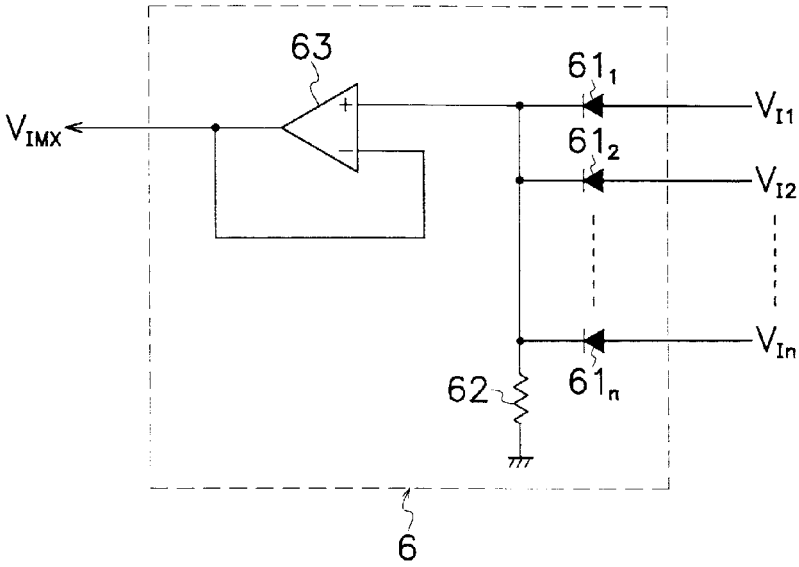
FIG. 4 An electric circuit diagram showing a detail of a maximum detection circuit.

As seen in FIG. 4, maximum detector 6 comprises first to $n^{th}$ commutation diodes $\mathbf{61}_1$ to $\mathbf{61}_n$ biased in the forward direction, each of commutation diodes $\mathbf{61}_1$ to $\mathbf{61}_n$ having an anode terminal connected to respectively first to $n^{th}$ current detectors $\mathbf{5}_1$ to $\mathbf{5}_n$ and a cathode terminal connected to each other, a detective resistor 62, for detecting maximum current, connected between each cathode terminal of commutation diodes $\mathbf{61}_1$ to $\mathbf{61}_n$ and ground, and a buffer amplifier 63 for producing a voltage at both ends of detective resistor 62 as a maximum detection voltage $V_{IMX}$. In operation of maximum detector 6 shown in FIG. 4, when detection voltages $V_{I1}$ to $V_{In}$ are applied from first to $n^{th}$ current detectors $\mathbf{5}_1$ to $\mathbf{5}_n$ to commutation diodes $\mathbf{61}_1$ to $\mathbf{61}_n$, the only highest one $V_{I2}$ of detection voltages $V_{I1}$ to $V_{In}$ can turn related commutation diode $\mathbf{61}_2$ on to raise at opposite ends of detective resistor 62 a voltage proportional to the highest voltage $V_{I2}$ and thereby deliver maximum detection voltage $V_{IMX}$ from output terminal of buffer amplifier 63.

Figure 5:
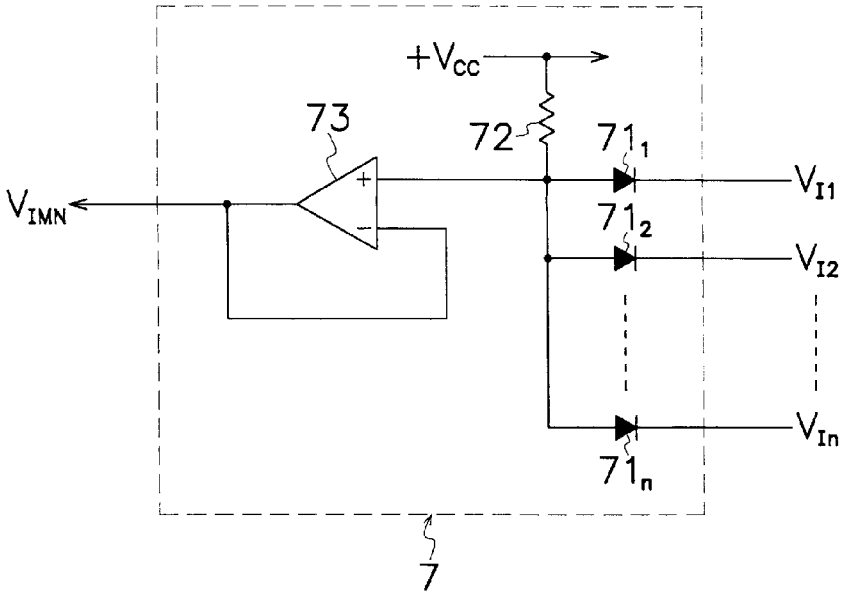
FIG. 5 An electric circuit diagram showing a detail of a minimum detection circuit.

As shown in FIG. 5, minimum detector 7 comprises first to $n^{th}$ commutation diodes $\mathbf{71}_1$ to $\mathbf{71}_n$ biased in the adverse direction, each of commutation diodes $\mathbf{71}_1$ to $\mathbf{71}_n$ having a cathode terminal connected to respectively first to $n^{th}$ current detectors $\mathbf{5}_1$ to $\mathbf{5}_n$ and an anode terminal connected to each other, a detective resistor 72 for detecting minimum current connected between each anode terminal of commutation diodes $\mathbf{71}_1$ to $\mathbf{71}_n$ and power source $+V_{CC}$ for drive, and a buffer amplifier 73 for producing a voltage at both ends of detective resistor 72 as a minimum detection voltage $V_{IMN}$. In operation of minimum detector 7 shown in FIG. 5, when detection voltages $V_{I1}$ to $V_{In}$ are applied from first to $n^{th}$ current detectors $\mathbf{5}_1$ to $\mathbf{5}_n$ to commutation diodes $\mathbf{71}_1$ to $\mathbf{71}_n$, the only lowest one $V_{I1}$ of detection voltages $V_{I1}$ to $V_{In}$ can turn related first commutation diode $\mathbf{71}_1$ on to raise at opposite ends of detective resistor 72 a voltage proportional to the lowest voltage $V_{I1}$ and thereby deliver minimum detection voltage $V_{IMN}$ from output terminal of buffer amplifier 73.

Figure 6:
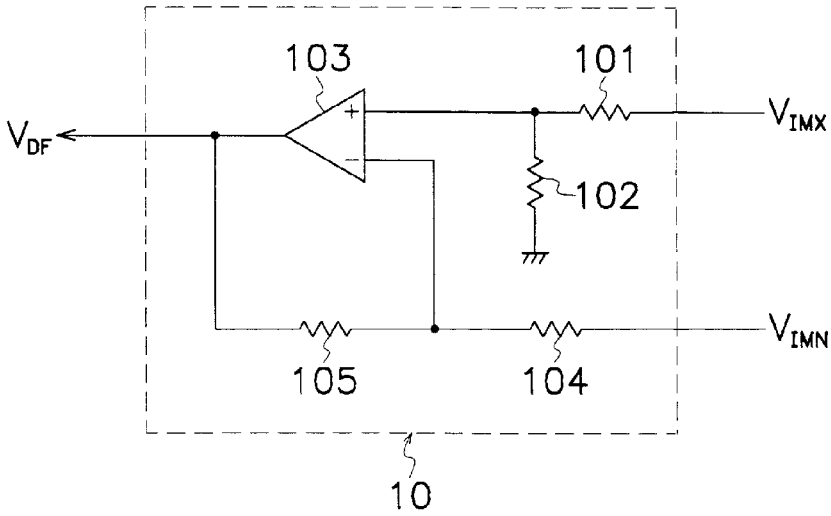
FIG. 6 An electric circuit diagram showing an operational amplification circuit.

As seen from FIG. 6, operational amplifier 10 comprises voltage dividing resistors 101 and 102 connected to maximum detector 6, an operational amplifier 103 provided with a non-inverted input terminal + connected to a junction of dividing resistors 101 and 102, a series resistor 104 connected between minimum detector 7 and an inverted input terminal − of operational amplifier 103, and a feedback resistor 105 connected between inverted input terminal − and an output terminal of operational amplifier 103. In operation of operational amplifier 10 shown in FIG. 6, maximum detector 6 applies maximum detection voltage $V_{IMX}$ on dividing resistors 101 and 102 and simultaneously minimum detector 7 applies minimum detection voltage $V_{IMN}$ on series resistor 104 so that operational amplifier 103 produces at its output terminal a differential voltage signal $V_{DF}$ between a divided voltage at junction of dividing resistors 101 and 102 to non-inverted input terminal + of operational amplifier 103 and a voltage at junction of series and feedback resistors 104 and 105.

Figure 7:
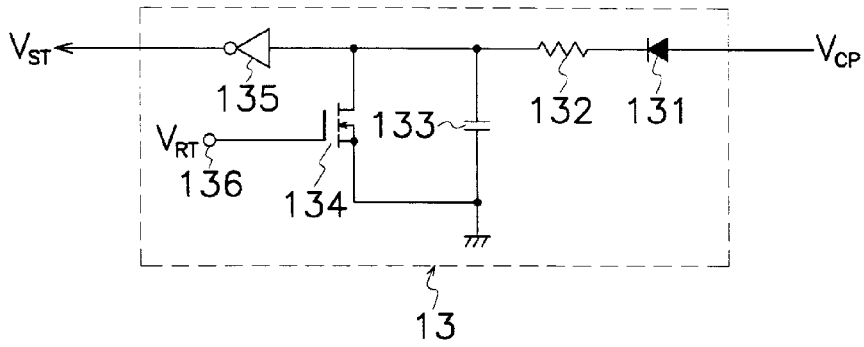
FIG. 7 An electric circuit diagram showing a retention circuit.

As presented in FIG. 7, retention circuit 13 comprises a backflow prevention diode 131 whose anode terminal is connected to output terminal of comparator 11 in comparison circuit 8, a resistor 132 whose one end is connected to cathode terminal of diode 131, a retention capacitor 133 connected between the other end of resistor 132 and ground, a MOS-FET 134 for electric discharge connected in parallel to retention capacitor 133, MOS-FET 134 having a gate terminal connected to a reset terminal 136 to turn MOS-FET 134 on when a reset signal $V_{RT}$ is applied to reset terminal 136, and an inversion amplifier 135 for inverting a voltage level of retention capacitor 133. In operation of retention circuit 13 shown in FIG. 7, when comparator 11 in comparison circuit 8 supplies a cease signal $V_{CP}$ of high voltage level to anode terminal of diode 131 to bias it in the forward direction, diode 131 is turned on, current flow through diode 131 and resistor 132 electrically charges retention capacitor 133 to thereby keep retention capacitor 133 at charged high voltage level which then is converted into an abeyance retention signal $V_{ST}$ of low voltage level through inversion amplifier 135. When reset signal $V_{RT}$ of high voltage level is applied on reset terminal 136, MOS-FET 134 is turned on to rapidly electrically discharge retention capacitor 133 so that inversion amplifier 135 switches abeyance retention signal $V_{ST}$ from low to high voltage level.

Figure 8:
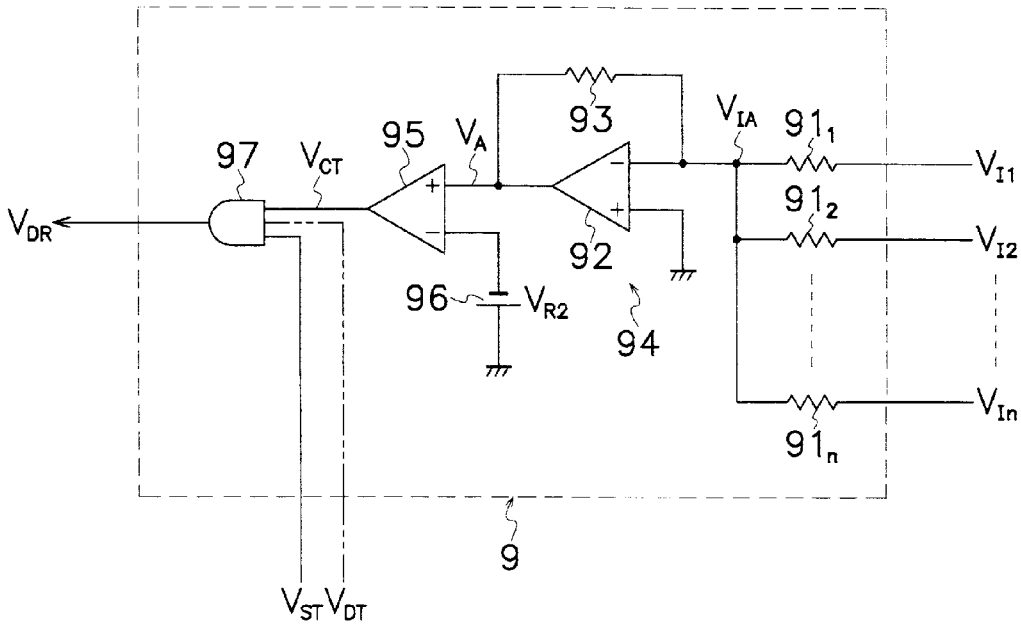
FIG. 8 An electric circuit diagram showing a control circuit.

As is apparent from FIG. 8, control circuit 9 comprises first to $n^{th}$ resistors $\mathbf{91}_1$ to $\mathbf{91}_n$ each having one end connected to first to $n^{th}$ current detectors $\mathbf{5}_1$ to $\mathbf{5}_n$ and the other end connected to each other, an operational amplifier 92 having a non-inverted input terminal + connected to ground and an inverted input terminal − connected to the other end of first to $n^{th}$ resistors $\mathbf{91}_1$ to $\mathbf{91}_n$, a feedback resistor 93 connected between inverted input terminal − and output terminal of operational amplifier 92, an output control comparator 95 having a non-inverted input terminal + connected to output terminal of operational amplifier 92 and an inverted input terminal − connected to ground through a normative power supply 96, and an AND gate 97 having input terminals for receiving control signal $V_{CT}$ from output control comparator 95 and abeyance retention signal $V_{ST}$ from retention circuit 13 to output, as a drive signal $V_{DR}$ to inverter 3, a logical product signal of control signal $V_{CT}$ and abeyance retention signal $V_{ST}$ at an output terminal of AND gate 97. Output comparator 95 produces control signals $V_{CT}$ of high and low voltage level when operational amplifier 92 produces output voltage $V_A$ respectively staying at or less than and exceeding reference voltage $V_{R2}$ of normative power supply 96. Operational amplifier 92 and feedback resistor 93 make up an amplification circuit 94 together. In operation of control circuit 9 shown in FIG. 8, when each of first to $n^{th}$ current detectors $\mathbf{5}_1$ to $\mathbf{5}_n$ produces detection voltage $V_{I1}$ to $V_{In}$ to each one end of first to $n^{th}$ resistors $\mathbf{91}_1$ to $\mathbf{91}_n$, detection voltages $V_{I1}$ to $V_{In}$ from current detectors $\mathbf{5}_1$ to $\mathbf{5}_n$ make up an average sum voltage $V_{IA}$ at a junction of the other ends of first to $n^{th}$ resistors $\mathbf{91}_1$ to $\mathbf{91}_n$. Average sum voltage $V_{IA}$ is given to inverted input terminal − of operational amplifier 92 for voltage amplification. When output voltage $V_A$ from operational amplifier 92 exceeds reference voltage $V_{R2}$ of normative power supply 96, output control comparator 95 switches its output control signal $V_{CT}$ from high to low voltage level to forward drive signals $V_{DR}$ of low voltage level from AND gate 97 to inverter 3 for control of AC output voltage from inverter 3. In this case, if comparator 11 in comparison circuit 8 produces a cease signal $V_{CP}$ of high voltage level, retention circuit 13 delivers abeyance retention signal $V_{ST}$ of low voltage level to AND gate 97, and therefore, AND gate 97 produces drive signal $V_{DR}$ of low voltage level to inverter 3 to stop operation of inverter 3 although output control comparator 95 outputs control signal $V_{CT}$ of high voltage level.

Figure 9:
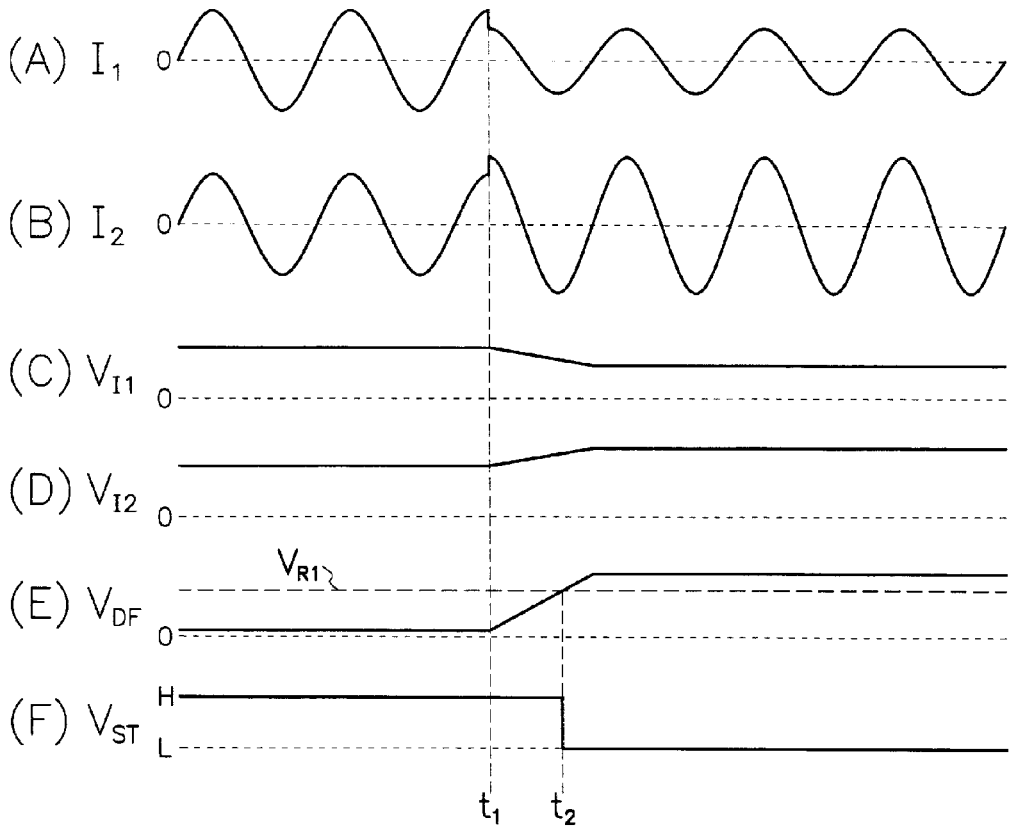
FIG. 9 A waveform diagram showing electric currents and voltages at selected locations in the electric circuit shown in FIG. 1 during operation.
Figure 10:
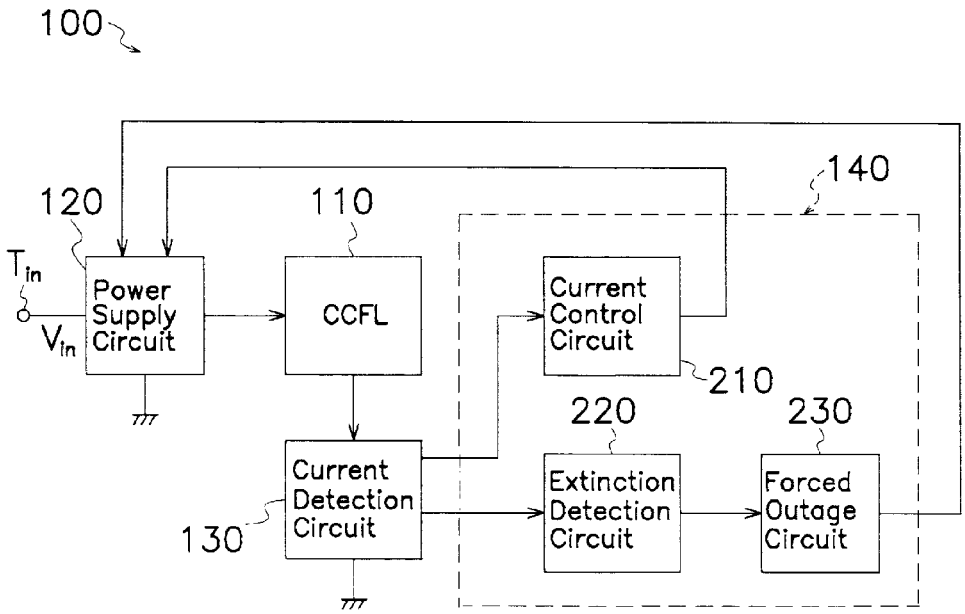
Fig. 10 Prior Art
FIG. 10 An electric circuit block diagram illustrating an example of prior art discharge lamp lighting devices.
Figure 11:
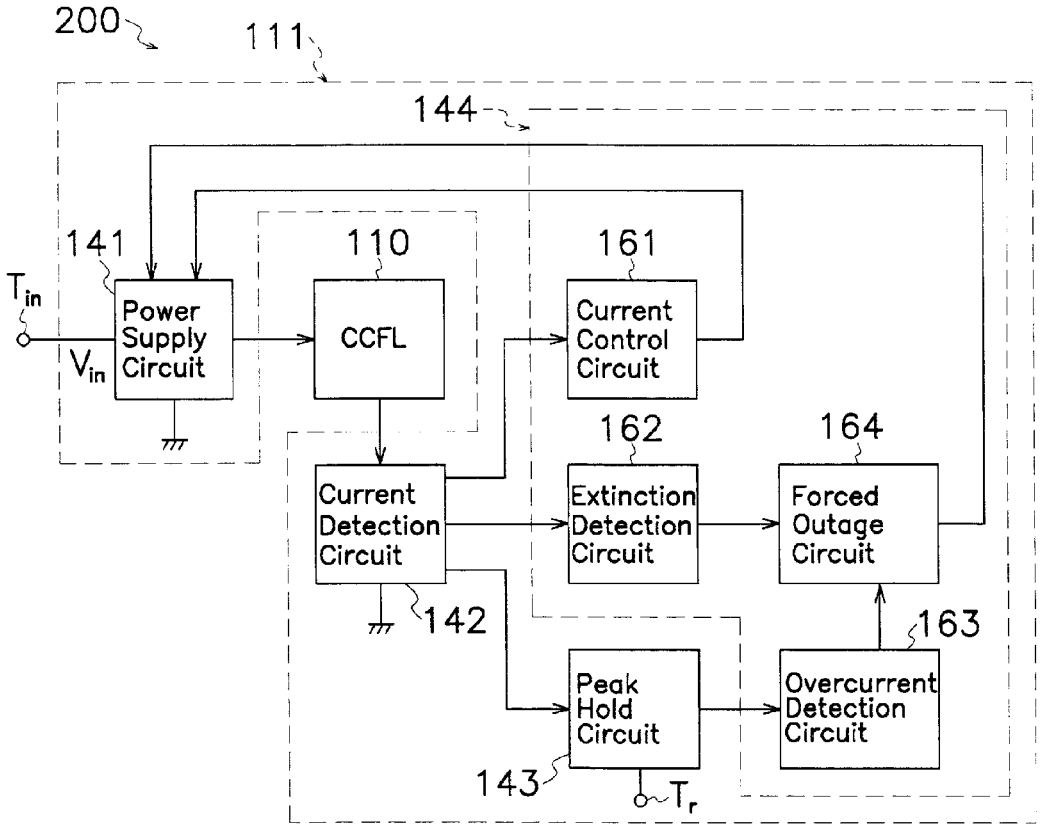
Fig. 11 Prior Art
FIG. 11 An electric circuit block diagram illustrating another example of prior art discharge lamp lighting devices.
Figure 12:
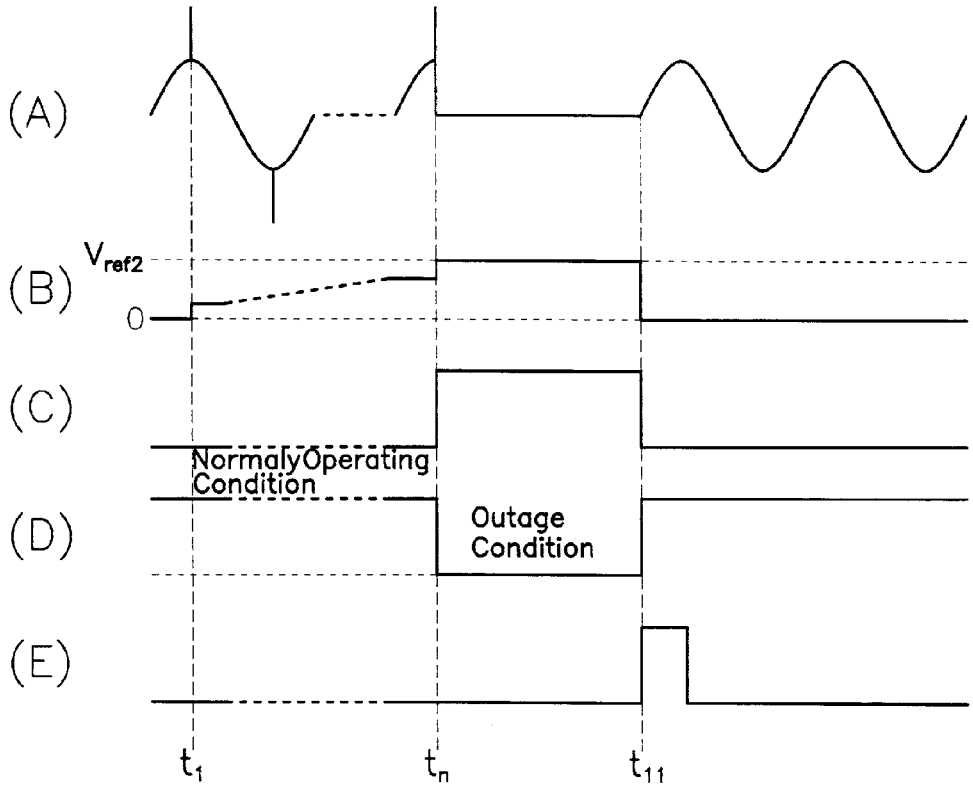
Fig. 12 Prior Art
FIG. 12 A waveform diagram showing voltages at selected locations in the electric circuit shown in FIG. 11 during operation.

Now, the following is a detailed description of operation regarding the discharge lamp lighting device according to the first embodiment shown in FIG. 1. Assuming that, for example, first discharge tube $\mathbf{1}_1$ brings about arc discharge in a space or spaces for accommodating causative contact failure between either one or both terminals of first discharge tube $\mathbf{1}_1$ and first output connector $\mathbf{14}_1$, $\mathbf{15}_1$ at point $t_1$ in time shown in FIG. 9, it reduces tube current $I_1$ flowing through first discharge tube $\mathbf{1}_1$ as shown in FIG. 9(A), and thereby, it increases tube currents $I_2$ to $I_n$ flowing through the rest second to $n^{th}$ discharge tubes $\mathbf{1}_2$ to $\mathbf{1}_n$ as shown in FIG. 9(B). This causes detection voltage $V_{I1}$ by first current detector $\mathbf{5}_1$ to gradually come down and converge toward a substantially constant value as shown in FIG. 9(C), whereas simultaneously, detection voltages $V_{I2}$ to $V_{In}$ by second to $n^{th}$ current detectors $\mathbf{5}_2$ to $\mathbf{5}_n$ gradually rise and converge toward a substantially constant value as shown in FIG. 9(D). However, note that FIGS. 9(B) and 9(D) illustrate only a sample case where the greatest tube current $I_2$ flows through second discharge tube $\mathbf{1}_2$.

When detection voltage $V_{I1}$ by first current detector $\mathbf{5}_1$ reaches its minimum value with reduction of tube current $I_1$ through first discharge tube $\mathbf{1}_1$, the arrangement turns on only first commutation diode $\mathbf{71}_1$ in minimum detector 7 to generate at opposite ends of resistor 72 a voltage proportional to detection voltage $V_{I1}$ by first current detector $\mathbf{5}_1$ so that buffer amplifier 73 in minimum detector 7 produces a minimum detection voltage $V_{IMN}$. On the other hand, tube current $I_2$ through second discharge tube $\mathbf{1}_2$ reaches its maximum value by increase in tube currents $I_2$ to $I_n$ through second to $n^{th}$ discharge tubes $\mathbf{1}_2$ to $\mathbf{1}_n$, while maximizes detection voltage $V_{I2}$ by second current detector $\mathbf{5}_2$ so that the arrangement turns on second diode $\mathbf{61}_2$ in maximum detector 6 to generate at opposite ends of resistor 62 a voltage proportional to detection voltage $V_{I2}$ by second current detector $\mathbf{5}_2$, thereby causing buffer amplifier 63 in maximum detector 6 to output maximum detection voltage $V_{IMX}$.

Maximum detection voltage $V_{IMX}$ from maximum detector 6 and minimum detection voltage $V_{IMN}$ from minimum detector 7 are given to operational amplifier 10 in comparison circuit 8 which produces a differential voltage signal $V_{DF}$ of FIG. 9(E) between maximum and minimum detection voltages $V_{IMX}$ and $V_{IMN}$. Then, comparator 11 compares differential voltage signal $V_{DF}$ from operational amplifier 10 with reference voltage $V_{R1}$ from normative power source 12, and produces cease signal $V_{CP}$ of high voltage level when differential voltage signal $V_{DF}$ exceeds reference voltage $V_{R1}$ at point $t_2$. Subsequently, cease signal $V_{CP}$ of high voltage level is transmitted to diode 131 which is therefore biased in the forward direction to turn it on. This causes current flow to run through diode 131 and resistor 132 to electrically charge retention capacitor 133 to a high voltage level and allow retention capacitor 133 to maintain high voltage level until reset signal $V_{RT}$ of high voltage level is supplied to reset terminal 136 to turn discharge MOS-FET 134 on. Inverting amplifier 135 inverts high level voltage in retention capacitor 133 to create abeyance retention signal $V_{ST}$ of low voltage level shown in FIG. 9(F) to AND gate 97 in control circuit 9. Thus, the device can cease operation of inverter 3 by applying drive signal $V_{DR}$ of low voltage level to inverter 3 from AND gate 97 regardless of voltage level in control signal $V_{CT}$ from output control comparator 95 in control circuit 9.

After that, if reset signal $V_{RT}$ of high voltage level is applied to reset terminal 136 of retention circuit 13 after contact failure is solved between either one or both terminals of first discharge tube $\mathbf{1}_1$ and first output connector $\mathbf{14}_1$, $\mathbf{15}_1$, discharge MOS-FET 134 in retention circuit 13 is turned on to rapidly discharge retention capacitor 133, and then, abeyance retention signal $V_{ST}$ of high voltage level is applied to AND gate 97 in control circuit 9 through inversion amplifier 135. This enables to resume operation of first to $n^{th}$ discharge tubes $\mathbf{1}_1$ to $\mathbf{1}_n$ and light up them most stably while controlling AC output voltage from inverter 3 depending on voltage level of control signal $V_{CT}$ from output control comparator 95 in control circuit 9 through AND gate 97.

In the discharge lamp lighting device according to the embodiment shown in FIG. 1, if first discharge tube $\mathbf{1}_1$ brings about arc discharge due to contact failure between either one or both terminals of first discharge tube $\mathbf{1}_1$ and first output connector $\mathbf{14}_1$, $\mathbf{15}_1$, it reduces tube current $I_1$ flowing through first discharge tube $\mathbf{1}_1$, and adversely, it increases tube currents $I_2$ to $I_n$ flowing through the rest second to $n^{th}$ discharge tubes $\mathbf{1}_2$ to $\mathbf{1}_n$, while augmenting the difference between maximum and minimum values $I_{MAX}$ and $I_{MIN}$ in tube currents $I_1$ to $I_n$ through discharge tubes $\mathbf{1}_1$ to $\mathbf{1}_n$. In this case, even with less reduction amount in tube current through first discharge tube $\mathbf{1}_1$ and related circuits where arc discharge happens, adversely, second to $n^{th}$ discharge tubes $\mathbf{1}_2$ to $\mathbf{1}_n$ indicate increased amount of tube currents $I_2$ to $I_n$ to widen the difference between maximum and minimum values $I_{MAX}$ and $I_{MIN}$ in tube currents $I_1$ to $I_n$. In this way, the present invention is characterized by the following features: 1) first to $n^{th}$ current detectors $\mathbf{5}_1$ to $\mathbf{5}_n$ detect tube current $I_1$ to $I_n$ through first to $n^{th}$ discharge tubes $\mathbf{1}_1$ to $\mathbf{1}_n$; 2) maximum and minimum detectors 6 and 7 respectively detect maximum and minimum detection voltages $V_{IMX}$ and $V_{IMN}$ which are respectively corresponding to maximum and minimum values $I_{MAX}$ and $I_{MIN}$ of tube currents $I_1$ to $I_n$ through first to $n^{th}$ discharge tubes $\mathbf{1}_1$ to $\mathbf{1}_n$; 3) operational amplifier 10 in comparison circuit 8 produces a differential signal $V_{DF}$ between maximum and minimum detection voltages $V_{IMX}$ and $V_{IMN}$; and 4) comparator 11 produces cease signal $V_{CP}$ to stop operation of inverter 3 through control circuit 9 when differential signal $V_{DF}$ exceeds reference voltage $V_{R1}$ of normative power source 12. Thus, the device can positively find out arc discharge provoked by bad connection of one or more discharge tubes $\mathbf{1}_1$ to $\mathbf{1}_n$ to cease feed of electric power to each discharge tube $\mathbf{1}_1$ to $\mathbf{1}_n$ from inverter 3 so that discharge tubes $\mathbf{1}_1$ to $\mathbf{1}_n$ can surely be protected from overheating by arc discharge at bad connection. Also, despite temporal fluctuation in value of tube current $I_1$ through first discharge tube $\mathbf{1}_1$ and related circuits where arc discharge happens, control circuit 9 can never restart inverter 3 since retention circuit 13 maintains voltage level of cease signal $V_{CP}$ from comparison circuit 8 to secure the outage condition for discharge tubes $\mathbf{1}_1$ to $\mathbf{1}_n$ from inverter 3 through transformers $\mathbf{4}_1$ to $\mathbf{4}_n$. For that reason, the device can prevent successive occurrence of arc discharge to obviate smoking and firing accidents by overheating at bad connections.

Figure 2:
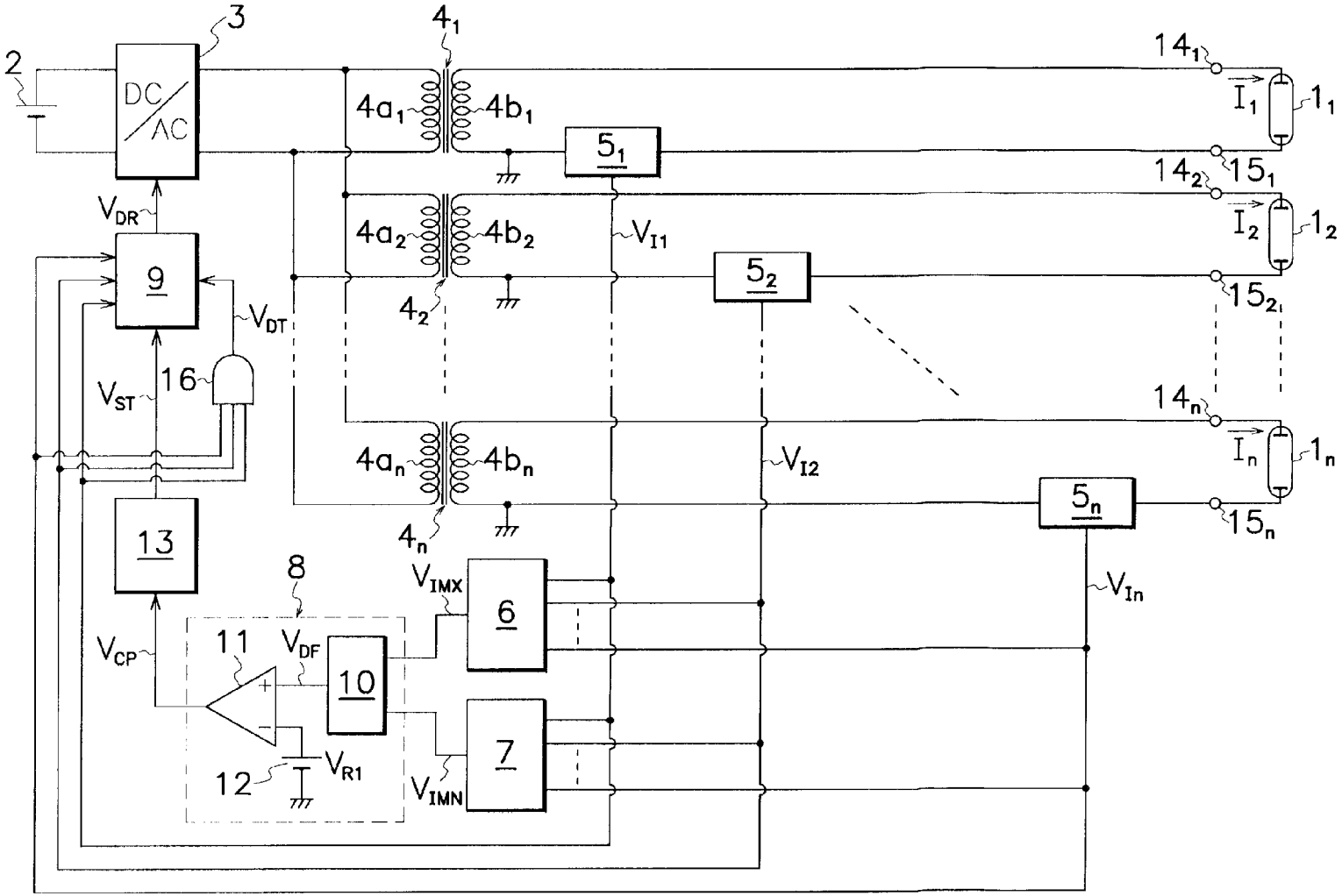
FIG. 2 An electric circuit diagram showing a second embodiment of the discharge lamp lighting device according to the present invention.

First embodiment of the discharge lamp lighting device shown in FIG. 1 may be varied in diverse ways. For example, FIG. 2 illustrates a second embodiment of the discharge lamp lighting device according to the present invention which comprises a disconnection detective AND gate 16 connected between first to $n^{th}$ current detectors $\mathbf{5}_1$ to $\mathbf{5}_n$ and control circuit 9 in FIG. 1 as a disconnection detection circuit for detecting extinction of tube currents $I_1$ to $I_n$ through at least a part or all of first to $n^{th}$ discharge tubes $\mathbf{1}_1$ to $\mathbf{1}_n$ to produce a detection signal $V_{DT}$. Each output terminal of first to $n^{th}$ current detectors $\mathbf{5}_1$ to $\mathbf{5}_n$ is connected to each input terminal of AND gate 16 whose output terminal is connected to an input terminal of AND gate 97 in control circuit 9 for transmission of a detection signal $V_{DT}$ as shown in phantom of FIG. 8. The rest configurations in FIG. 2 are substantially similar to those in FIG. 1.

In the discharge lamp lighting device shown in FIG. 2, for example, when electrical disconnection happens at a portion or all of connections between secondary windings $\mathbf{4}b_1$ to $\mathbf{4}b_n$ of first to $n^{th}$ transformers $\mathbf{4}_1$ to $\mathbf{4}_n$ and first to $n^{th}$ discharge tubes $\mathbf{1}_1$ to $\mathbf{1}_n$, a part or all of tube currents $I_1$ to $I_n$ disappear from first to $n^{th}$ discharge tubes $\mathbf{1}_1$ to $\mathbf{1}_n$, and a part or all detection voltages $V_{I1}$ to $V_{In}$ of first to $n^{th}$ current detectors $\mathbf{5}_1$ to $\mathbf{5}_n$ come to nearly zero so that AND gate 16 produces a detection signal $V_{DT}$ of low voltage level. Accordingly, AND gate 97 in control circuit 9 issues a drive signal $V_{DR}$ of low voltage level to inverter 3 which therefore stops its operation to avoid occurrence of arc discharge at a disconnection area upon application of high voltage on first to $n^{th}$ discharge tubes $\mathbf{1}_1$ to $\mathbf{1}_n$.

The foregoing embodiments can be subject to further various modifications. For example, these embodiments are shown to have maximum and minimum detectors 6 and 7 for detecting with high precision respectively maximum and minimum values $I_{MAX}$ and $I_{MIN}$ of tube currents $I_1$ to $I_n$ of first to $n^{th}$ discharge tubes $\mathbf{1}_1$ to $\mathbf{1}_n$ to compute in operational amplifier 10 the differential current value between maximum and minimum values $I_{MAX}$ and $I_{MIN}$. In lieu of or in addition to the differential or subtracted current value, the present invention may utilize one or more calculated values of sum, product and quotient between maximum and minimum values $I_{MAX}$ and $I_{MIN}$. In this case, in place of or in addition to operational amplifier 10 for subtraction, the calculator may include adding, multiplying and dividing circuits and composite circuits thereof and/or other various computing or calculating circuits. Also, according to the foregoing embodiments, first to $n^{th}$ current detectors $\mathbf{5}_1$ to $\mathbf{5}_n$ monitor only a positive half cycle of tube currents $I_1$ to $I_n$ flowing through first to $n^{th}$ discharge tubes $\mathbf{1}_1$ to $\mathbf{1}_n$, however, first to $n^{th}$ current detectors $\mathbf{5}_1$ to $\mathbf{5}_n$ may monitor a full cycle of tube currents $I_1$ to $I_n$ to detect maximum and minimum detection voltages $V_{IMX}$ and $V_{IMN}$. Moreover, the foregoing embodiments may utilize discharge lamps of other types than cold cathode fluorescent discharge tubes such as mercury lamps, neon discharge lamps, high intensity discharge (HID) lamps.

INDUSTRIAL APPLICABILITY

The present invention is effectively applicable to discharge lamp lighting devices for concurrently lighting or turning on a plurality of discharge lamps through a simple inverter circuit of high voltage output.

What is claimed are:

1. A discharge lamp lighting device comprising:

an inverter circuit for converting DC voltage from a DC power source into AC voltage, a plurality of transformers which include a plurality of primary windings and a plurality of secondary windings, each of said primary windings being in parallel connection to output terminals of said inverter circuit, discharge lamps each connected to respective secondary windings, tube current detecting circuits connected between the secondary winding of said transformers and discharge lamps for detecting tube currents through said discharge lamp to produce detection signals of the level corresponding to the detected tube current, a maximum detection circuit for detecting a maximum value of detected signals from the current detector, a minimum detection circuit for detecting a minimum value of detected signals from the current detector, a comparison circuit for computing one or plural values of sum, difference, product and quotient between maximum value from maximum detector and minimum value from minimum detector to generate a cease signal when the computed value exceeds a predetermined value, and a control circuit for halting operation of the inverter circuit when said comparison circuit generates the cease signal.

2. The discharge lamp lighting device of claim 1, wherein said comparison circuit comprises an operational amplification circuit for outputting a differential signal between the maximum value from the maximum detection circuit and the minimum value from the minimum detection circuit, and a comparator for producing a cease signal when the differential signal from the operational amplification circuit exceeds a predetermined reference voltage.

3. The discharge lamp lighting device of claim 1 or 2, further comprising: a retention circuit connected between the comparison circuit and control circuit for maintaining a voltage level of the cease signal from the comparison circuit until a reset signal is applied to a reset terminal of the retention circuit.

4. The discharge lamp lighting device of any one of claims 1 to 3, further comprising: a disconnection detection circuit for detecting extinction of a part or all tube currents flowing through the discharge lamps to produce a detection signal, wherein said control circuit stops operation of the inverter circuit when said disconnection detection circuit produces the detection signal.

* * * * *